US005738169A

United States Patent [19]

Stoynoff

[11] Patent Number: 5,738,169

[45] Date of Patent: Apr. 14, 1998

[54] HEAT EXCHANGER WITH TURBULATED LOUVERED FIN, MANUFACTURING APPARATUS AND METHOD

[75] Inventor: Richard P. Stoynoff, Woodhaven, Mich.

[73] Assignee: Livernois Research & Development Co., Dearborn, Mich.

[21] Appl. No.: 554,482

[22] Filed: Nov. 7, 1995

[51] Int. Cl.[6] ..... F28D 1/02

[52] U.S. Cl. ..... 165/152; 165/151

[58] Field of Search ..... 165/152, 153, 165/183, 151

[56] References Cited

U.S. PATENT DOCUMENTS

| | | | |
|---|---|---|---|
| 1,862,219 | 6/1932 | Harrison . | |
| 1,887,036 | 11/1932 | Modine . | |
| 2,789,797 | 4/1957 | Simpelaar . | |
| 3,003,749 | 10/1961 | Morse . | |
| 3,145,586 | 8/1964 | Brearley et al. . | |
| 3,298,432 | 1/1967 | Przyborowski | 165/153 |
| 4,067,219 | 1/1978 | Bianchi . | |
| 4,328,861 | 5/1982 | Cheong et al. . | |
| 4,469,168 | 9/1984 | Itoh et al. . | |
| 4,676,304 | 6/1987 | Koisuka et al. . | |
| 4,815,531 | 3/1989 | Presz, Jr. et al. | 165/151 |
| 5,372,187 | 12/1994 | Haushalter | 165/152 X |
| 5,511,610 | 4/1996 | Lu | 165/152 X |

FOREIGN PATENT DOCUMENTS

| | | | |
|---|---|---|---|
| 69396 | 4/1983 | Japan | 165/151 |
| 87790 | 4/1987 | Japan | 165/151 |
| 38597 | 2/1989 | Japan | 165/152 |
| 142197 | 8/1993 | Japan | 165/151 |

OTHER PUBLICATIONS

"It's time to change . . . Introducing the XFR-1 Form Roll," (printed by Livernois Engineering Company, Heat Exchange Division.

*Primary Examiner*—Leonard R. Leo
*Attorney, Agent, or Firm*—Brooks & Kushman P.C.

[57] ABSTRACT

A heat exchanger, method of manufacturing, and manufacturing apparatus including at least one row of flattened tubes along which a heat exchange medium may pass. A serpentine fin is supported between adjacent tubes. The fin defines a plurality of louvers therein, each louver forming an elongated slit. A fluid to be heated or cooled by the medium may pass through the slit. A corrugated edge is formed upon one or more of the louvers for creating turbulence in the fluid. This turbulence disturbs laminar flow of the fluid across the associated louver and promotes a transfer of thermal energy between the medium in the tubes and the fluid.

8 Claims, 8 Drawing Sheets

HEAT EXCHANGER WITH TURBULATED LOUVERED FIN, MANUFACTURING APPARATUS AND METHOD

TECHNICAL FIELD

This invention relates to heat exchangers utilizing physical media to either extract heat or cold from a source.

BACKGROUND ART

In the heat exchange industry, it is generally known that a layer or film of fluid of indefinite thickness exists when a heat- or cold-transferring fluid contacts with a surface having a different thermal energy than the fluid. That layer is in direct contact with the heating surface, to which it tends to adhere and form a relatively thermally insulating covering. The covering reduces the rate of transfer of thermal energy to those regions of the fluid which are located away from the heating surface. Such adherence is explained by friction between the fluid and the surface which causes the layer to move more slowly in relation to the more remote layers of fluid which may pass relatively unencumbered over the adherent layer. Such phenomena tend to diminish the efficiency of a heat exchanger. As a result, prior art heating approaches have used relatively large areas of heating surface in order to heat a fluid to a desired temperature.

Conventional approaches have addressed the problem by disturbing this essentially non-conductive layer and enabling most of the fluid to be heated to come into direct contact with the heating surface. However, such approaches have been only somewhat effective in raising the efficiency of a heat exchanger. Illustrative of prior approaches are the disclosures of U.S. Pat. Nos. 1,862,219; 1,887,036; 2,789,797; 3,003,749; 4,328,861; 4,469,168; and 4,676,304.

During the past fifteen years or so, the louvered serpentine fin in conventional heat exchangers has undergone many slight modifications to optimize the existing variables that describe the fin. Louver width has varied, louver angle has varied, louver length has increased, bend radii have improved, louver patterns have been experimented with, and fin materials have become more versatile and thinner. But through all the experimentation and slight improvements, the free edge of the louver itself has remained relatively untouched.

It is the louver that deflects or directs the air and channels heat or coldness from a source. In existing designs, little turbulation actually occurs and laminar flow is relatively uninterrupted.

It is known that the more the heating or cooling media can be turbulated, the more efficient the heat exchanger. One of the reasons for this is the breaking down of boundary layers of stagnant media from which no thermal energy can be extracted. One of the effects of increased turbulation in automotive radiators is known as "air side pressure drop". As turbulation increases, more air pressure is required to pass a given volume of air through the core. Air, in the case of automotive radiators, is the medium by which the heat is removed. If too much air pressure is required, the core becomes penalized during efficiency tests. There is an optimum volume of air that must pass through the core in a given time so the vehicle does not experience front end pressure increase, and the air in the engine compartment becomes stagnant. This measured pressure drop, along with the BTU rating comprise an efficiency curve. If the BTU rating and the pressure are high, less fins per inch can be used. This is an actual savings to the heat exchanger manufacturer because he can use less fin material.

A related need in the ideal turbulated louver is structural strength. For economical reasons, the heat exchange industry has reduced the thickness of its fin material. With the introduction of environmentally compatible cooling agents in air conditioners, operating pressures have been increased in order to maintain efficiency sometimes with adverse effects on efficiency and core life.

SUMMARY OF THE INVENTION

A heat exchanger is disclosed which includes at least one row of flattened tubes along which a heat exchange medium may pass. A serpentine fin is supported between adjacent tubes. The fin defines a plurality of louvers therein, each louver forming an elongated slit between it and the fin. A fluid to be heated or cooled by the medium may pass through the slit.

A corrugated edge is formed upon one or more of the louvers for creating turbulence in the fluid. This turbulence disturbs laminar flow of the fluid across the associated louver and promotes a transfer of thermal energy between the medium in the tubes and the fluid.

BEST MODES FOR CARRYING OUT THE INVENTION

A new turbulator fin is needed to address concerns of cost, performance, strength, and create a direct replacement component for the currently used louvered serpentine fin. Thus, an object of the present invention is to provide a shape which creates turbulence.

Small turbulating structures are designed into the louver. These small turbulators exist on the extreme flank edge of the louver slitting area and blend into the full body of the louver structure of the blade.

A major difference between the new turbulator fin of this invention and the currently used louvered serpentine fin is redesign of the part of the fin that does most of the work—the louvers.

It is not necessary that turbulators exist on both edges of the louvers. It is not necessary that they have a specific pattern or shape, only that a secondary structure causes turbulence by some means other than the main louver body.

Figure 1A:
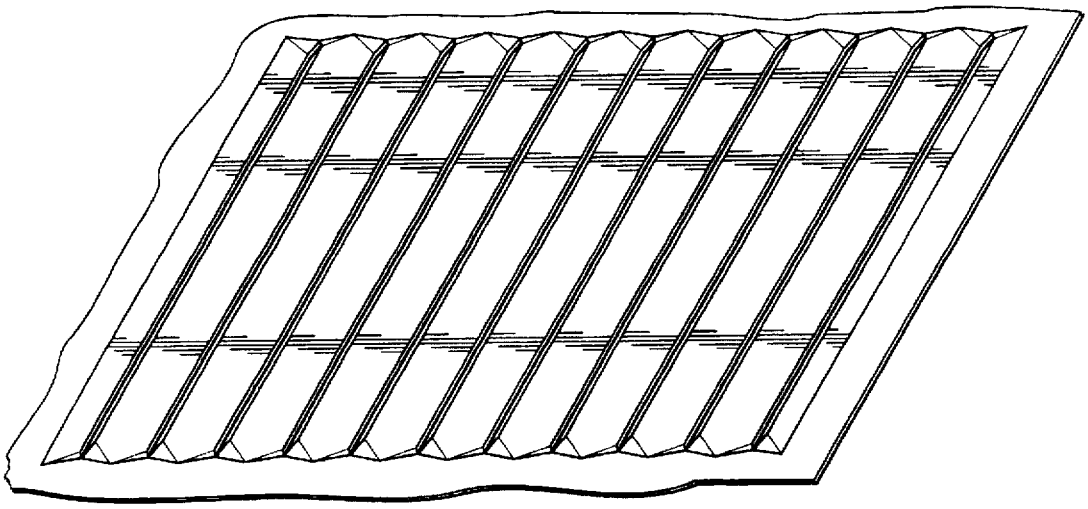
Fig. 1a (PRIOR ART)
FIG. 1*a* discloses a serpentine fin found in prior art heat exchangers.
Figure 1B:
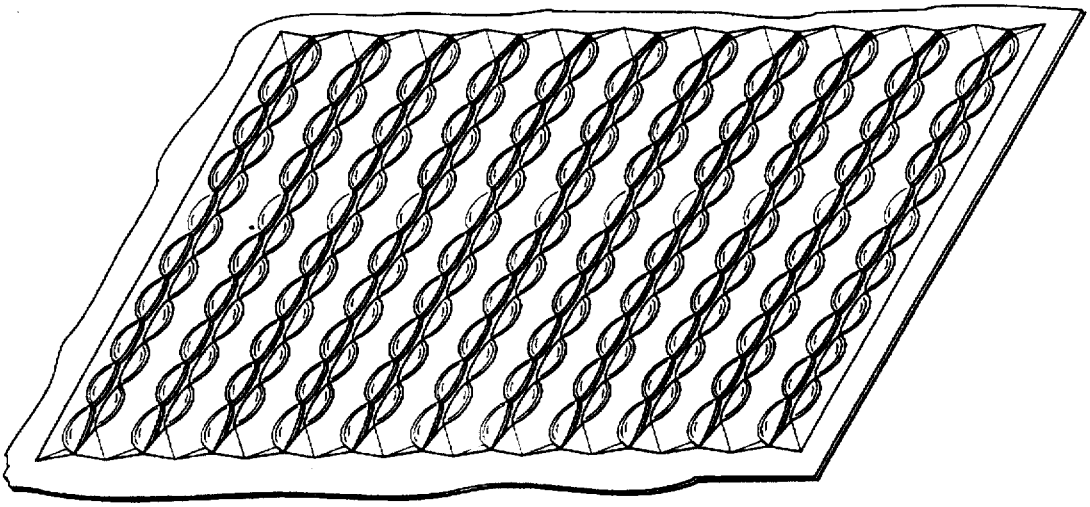
FIG. 1*b* depicts a serpentine fin disposed in a heat exchanger made in accordance with the present invention.
Figure 2A:
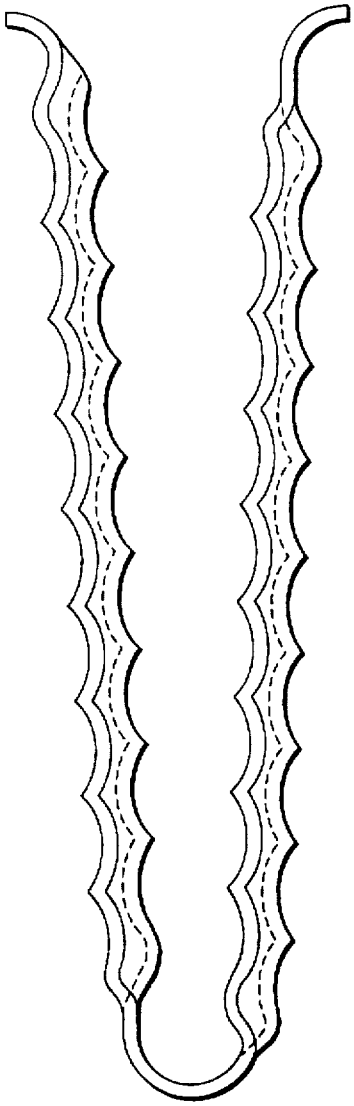
FIG. 2*a* is a sectional view of a serpentine fin illustrating corrugated edges formed into the louvers thereof.
Figure 2B:
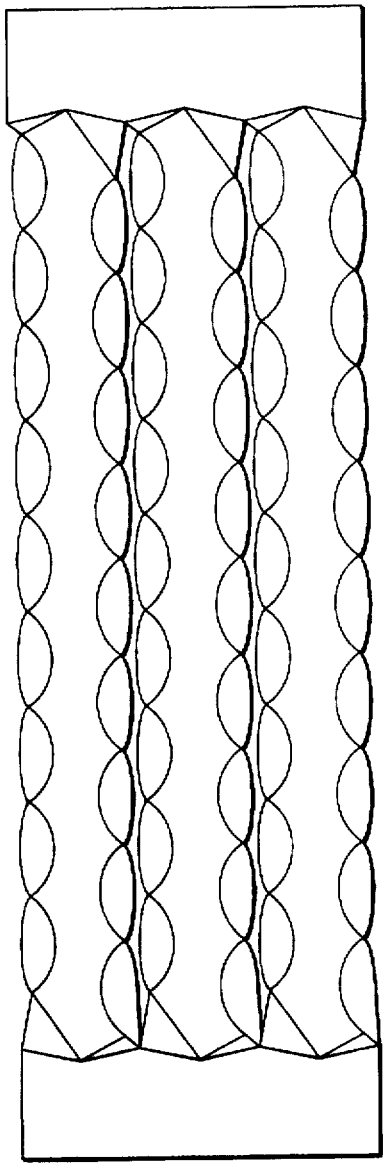
FIG. 2*b* is a top plan view of the configuration illustrated in FIG. 2*a;*
Figure 2C:
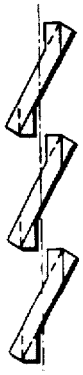
FIG. 2*c* is a side elevational view of the louver configuration depicted in FIG. 2*a.*
Figure 3A:
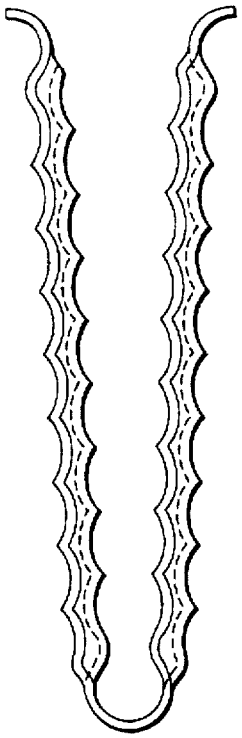
FIG. 3*a* is a sectional view of a serpentine fin illustrating corrugated edges formed into the louvers thereof.
Figure 3B:
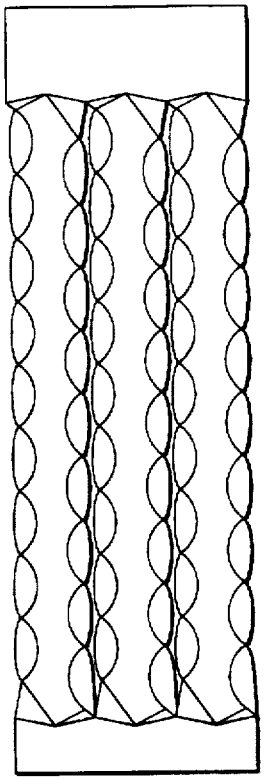
FIG. 3*b* is a is a top plan view of the configuration illustrated in FIG. 3*a;*
Figure 4A:
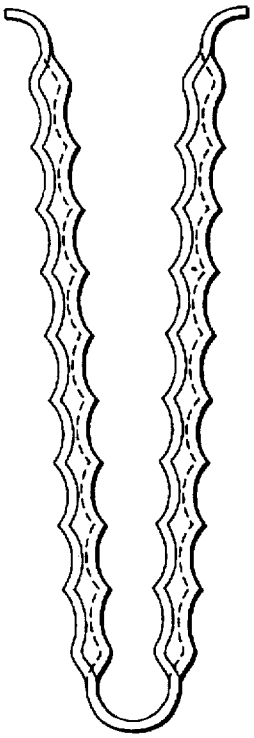
FIG. 4*a* is a sectional view of a serpentine fin illustrating corrugated edges formed into the louvers thereof.
Figure 4B:
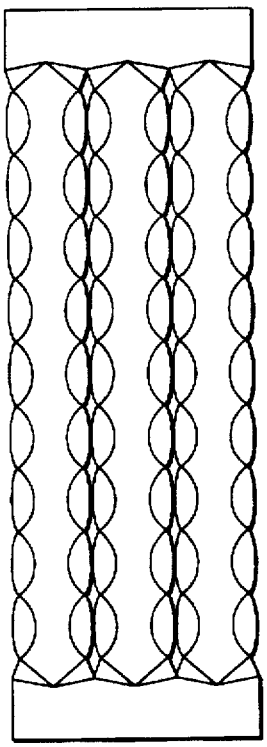
FIG. 4*b* is a is a top plan view of the configuration illustrated in FIG. 4*a;*
Figure 5A:
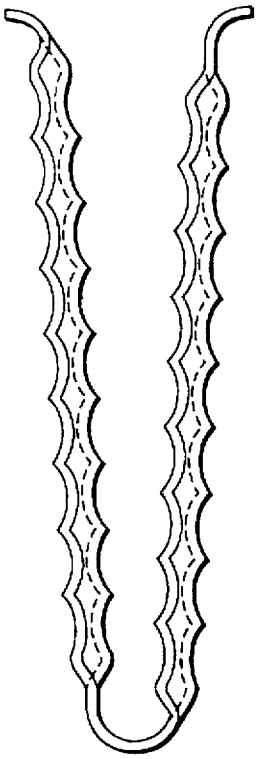
FIG. 5*a* is a sectional view of a serpentine fin illustrating corrugated edges formed into the louvers thereof.
Figure 5B:
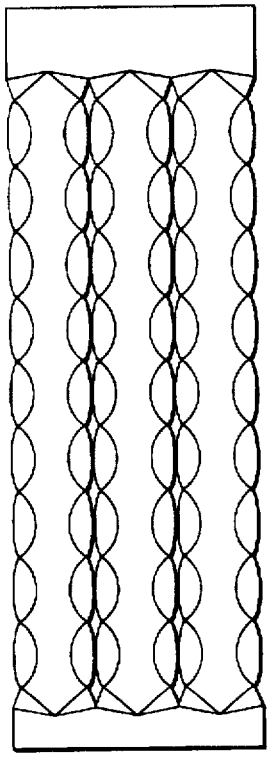
FIG. 5*b* is a is a top plan view of the configuration illustrated in FIG. 5*a;*
Figure 6A:
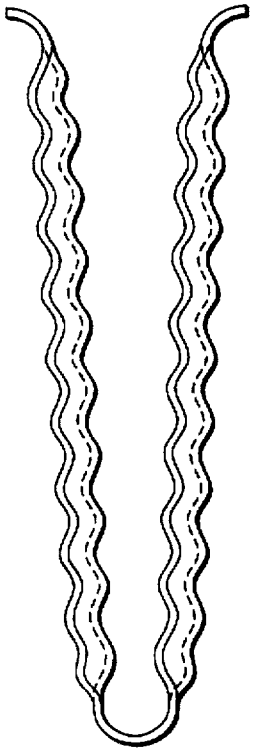
FIG. 6*a* is a sectional view of a serpentine fin illustrating corrugated edges formed into the louvers thereof.
Figure 6B:
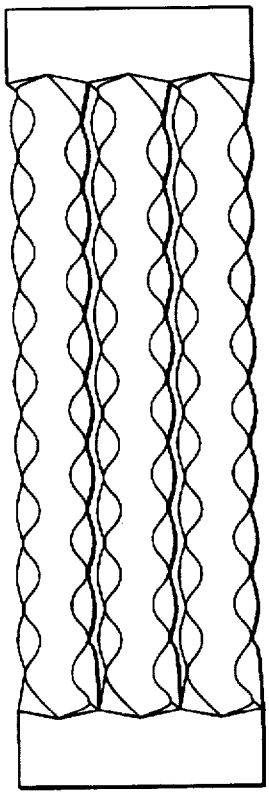
FIG. 6*b* is a is a top plan view of the configuration illustrated in FIG. 6*a;*
Figure 7A:
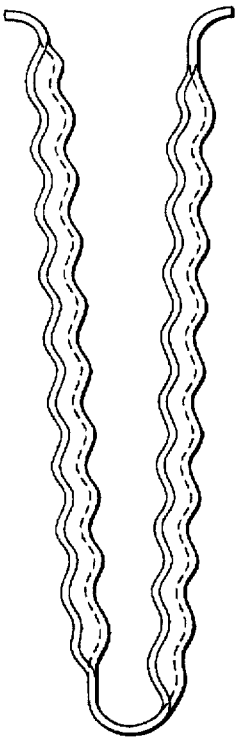
FIG. 7*a* is a sectional view of a serpentine fin illustrating corrugated edges formed into the louvers thereof.
Figure 7B:
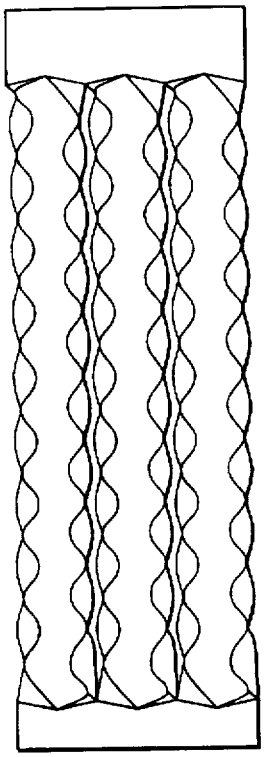
FIG. 7*b* is a is a top plan view of the configuration illustrated in FIG. 7*a;*
Figure 8A:
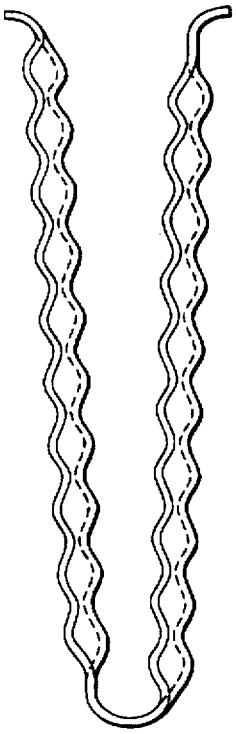
FIG. 8*a* is a sectional view of a serpentine fin illustrating corrugated edges formed into the louvers thereof.
Figure 8B:
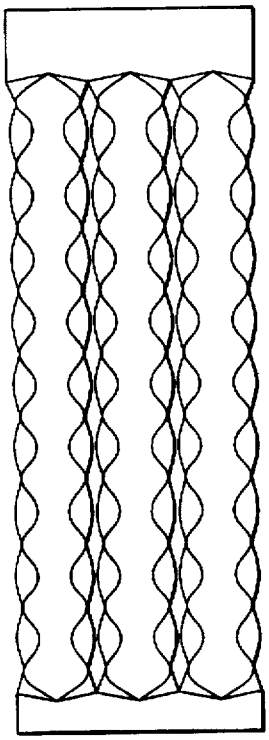
FIG. 8*b* is a is a top plan view of the configuration illustrated in FIG. 8*a;*
Figure 9A:
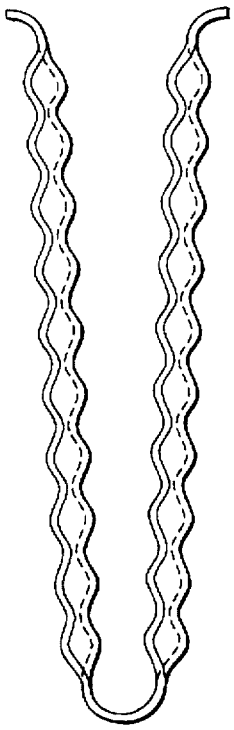
FIG. 9*a* is a sectional view of a serpentine fin illustrating corrugated edges formed into the louvers thereof.
Figure 9B:
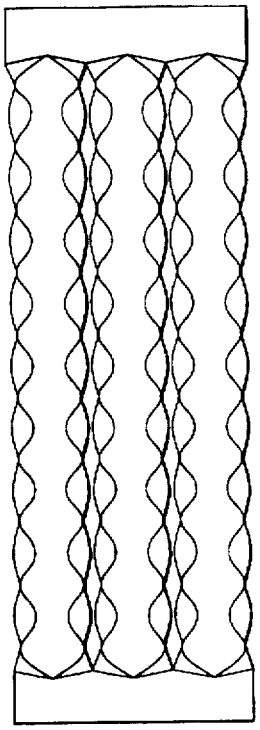
FIG. 9*b* is a is a top plan view of the configuration illustrated in FIG. 9*a;*
Figure 10:
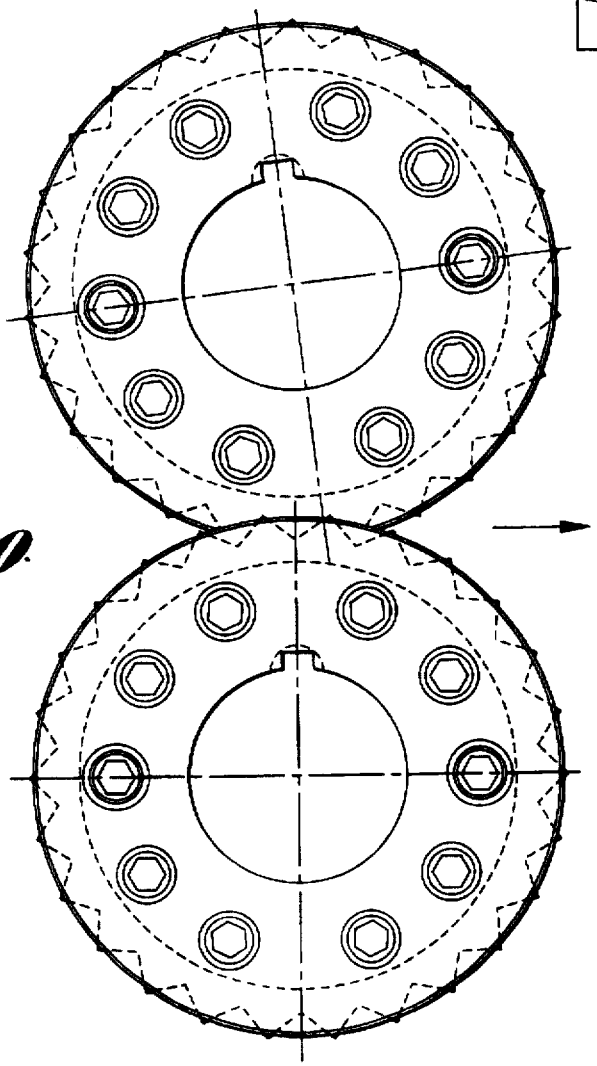
FIG. 10 illustrates a pair of serpentine roll forming tools used in the manufacturing apparatus for making the heat exchanger of the disclosed invention.

The process used to create this new type of fin is roll forming (FIG. 10). The drawings depict the manufacturing of the tool which creates a fin according to the present invention. During the roll forming process, some distortion of the fin occurs. This is due to the speed differential between the tooth tip and the bottom of the tooth space.

Forming by this method automatically distorts true radial representation of arcs into cycloidal or parabolic shapes. This distortion increases the farther the form is from the running pitch diameter, which exists halfway between the tool centers. Distortion can be compensated for if the need arises.

The present invention discloses a turbulator which creates minute eddies and currents which scrub the heat exchanger surface and thermal energy is more efficiently transferred to the turbulated media.

The disclosed turbulated fin creates these minute eddies and currents and still maintain the louver's deflection properties in order to direct the exit of the heat/cool saturated media.

Several turbulator shapes have been sketched to show versatility. Their shape and/or frequency can be engineered according to user preference. See, e.g., FIGS. 1–9.

This new type of fin roll will be able to make more finished fins than the conventional fin rolls before it is considered "worn out" for several reasons. The slitting action of the louver is analogous to operating a pair of scissors. The small flat surface along the cutting edge of the fin blade actually does the slitting and is subject to the most wear. Conventional fin rolls have a cutting edge flat surface that is constant along almost the entire flank length of the blade. As this small flat surface wears, it creates an increasingly larger burr on the fin louver which may be constant along the entire length of the louver. As this burr gets larger due to cutting edge breakdown, it creates an obstruction which inhibits the passage of air through the fin, and thus inhibits heat transfer.

The serrated louvered blade, i.e. the cutting edge flat surface, is not constant. It is appreciably wider at the bottom of the turbulating scallops. The wear point is localized at the peak where any two adjacent scallops intersect. At this localized point, the cutting edge flat surface is approximately the size of the conventional cutting flat surface. This area will be more subject to wear than any other area since the cutting edge flat surface is at its narrowest here. The peak of the form performs more of a piercing operation than a slitting one.

This has two advantages with respect to tool life. First, it localizes any burr caused from cutting edge breakdown into an area on the fin which may actually help to increase air turbulence. Second, it pierces a start for the louver slit instead of relying on the blunt edge shearing actions which start the louver slit on the conventional fin roll. This decreases required shearing forces which transmit to the bearings that support the fin roll, thus reducing "bouncing" or vibration. It also reduces the amount of torque forces required to roll form the louvered fin.

The "scallop" has been designed as concave with respect to its location along the periphery of the tooth flank of each fin blade. This does not imply that it cannot be a convex shape. The tooth form should have no bearing on the existence of the turbulating scallops. The tooth form aids in bending the fin into its final serpentine shape. Turbulating scallops need not be on every cutting edge in exactly the same shape or pattern. A mixture of turbulator shapes, frequency of existence, patterns, and locations are possible.

At this time, radiator cores are being constructed for performance testing. Preliminary testing of the new turbulated fin and the fin it is to replace have been done on a "JODON" machine. This machine is the automotive standard for measuring louver angle.

Figure 11:
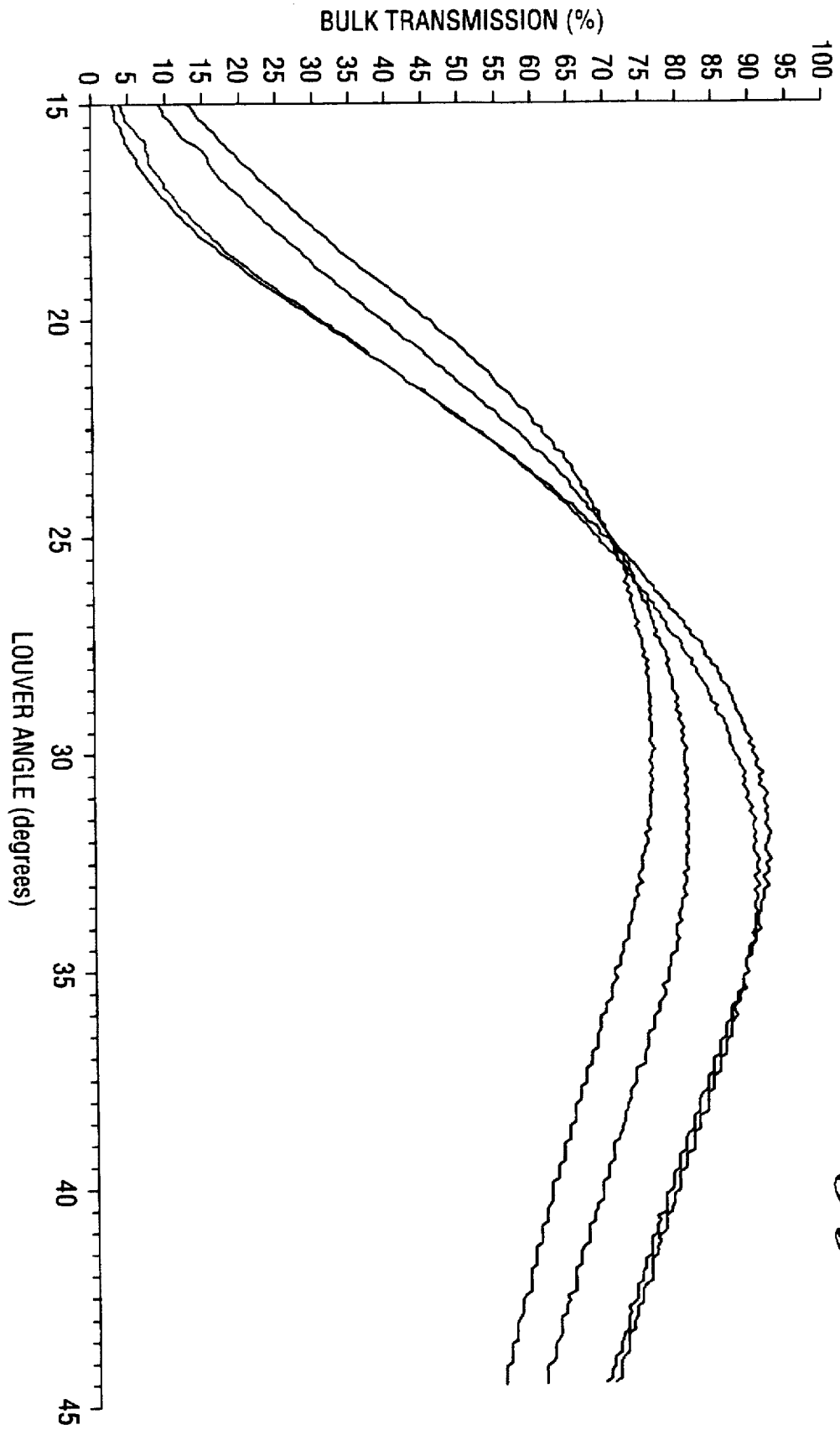
FIG. 11 is a graph of bulk transmission (%) in relation to louver angle (degrees)
Figure 12:
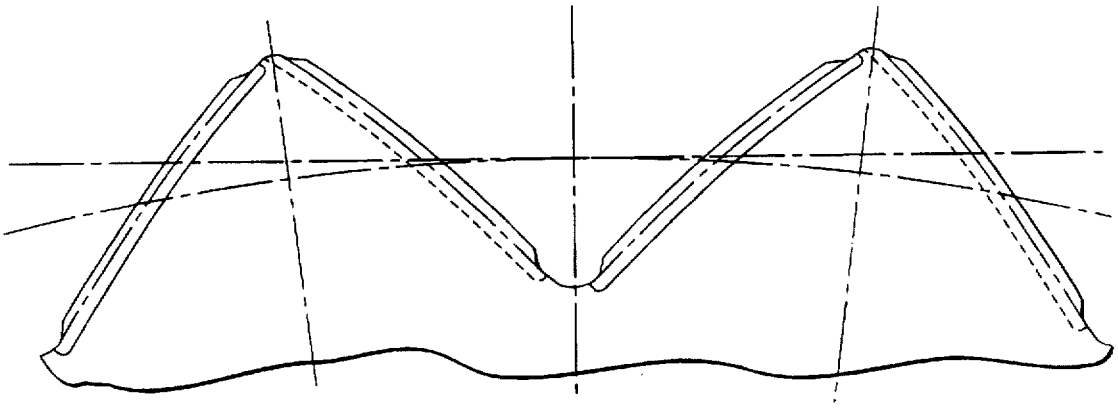
Fig. 12 (PRIOR ART)
FIG. 12 illustrates a prior art roll forming tool which creates a prior art fin.
Figure 13:
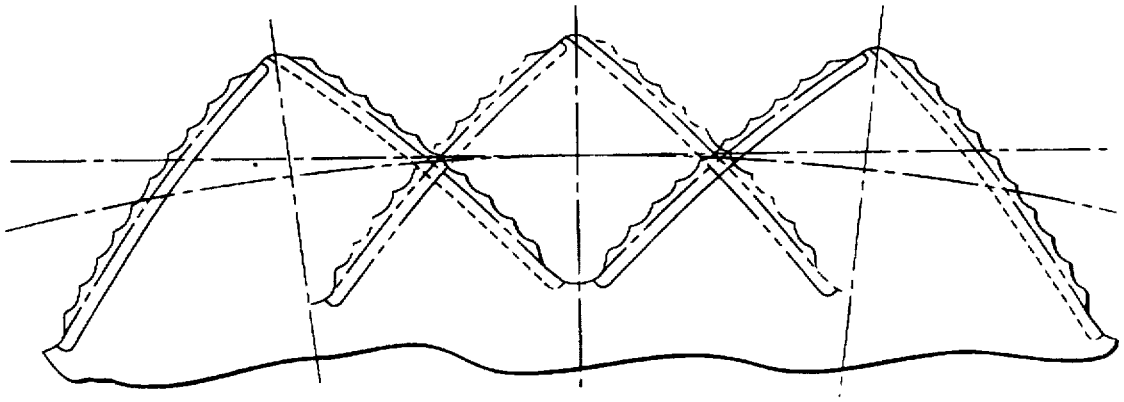
FIG. 13 depicts a roll manufactured in order to create a fin according to the present invention.

This machine works basically as follows. A fin panel is mounted on a rotary fixture which exists between a light source and a receptor. The fin panel is rotated back and forth on an axis which is along the louver slit. A high intensity light is aimed at the receptor. As the louver is rotated, it either allows light to pass through the fin or cuts it off. The receptor sensor detects the amount of light and stores this value for each increment of a degree the fin is rotated. The maximum light at any given rotation value indicates the maximum base louver angle. A graph is generated (FIG. 11) with the "X" axis as the angle the fin has been rotated. The "Y" axis is the total amount of light the receptor sees based on a maximum value approaching 100%. Four banks of louvers are tested at a time.

"Bulk transmission" is or maximum light the receptor sees. Approximately 6% less light passed through the new type of fin. This indicates that the turbulators will effectively interrupt air flow, hence, create turbulence, and raise BTU performance.

Crush tests on the new fin and the old style louvered fin have been performed and show an approximate increase in column strength of 12 to 13%.

The new turbulator louvered fin does not require any core building process changes in manufacturing cores with serpentine fins. It is a direct replacement product. It is more efficient, stronger, and allows the core manufacturer to experience a real cost savings. It is a very viable solution to the problem of creating a more efficient heat exchanger.

What is claimed is:

1. A heat exchanger comprising:

at least one row of flattened tubes through which a heat exchange medium may pass;

a serpentine fin supported between adjacent tubes, the fin defining a plurality of louvers therein, each louver forming an elongated slit through which a fluid to be heated or cooled by the medium may pass; and a corrugated edge that extends from a generally flat basal portion of one or more of the louvers for creating turbulence in the fluid, thereby disturbing laminar flow of the fluid across the louvers and promoting transfer of thermal energy between the medium in the tubes and the fluid.

2. The heat exchanger of claim 1 wherein the plurality of louvers is oriented orthogonally to a direction of fluid flow between the tubes.

3. The heat exchanger of claim 1 wherein the serpentine fin comprises:

a plurality of connected undulating sections connected by a bridging section, wherein the louvers are formed in the undulating sections.

4. The heat exchanger of claim 1 wherein the heat exchange medium is selected from the group consisting of FREON®, water, ethylene glycol, oil, fuel, blood, and air.

5. A heat exchanger comprising:

at least one row of flattened tubes through which a heat exchange medium may pass;

a serpentine fin supported between adjacent tubes, the fin defining a plurality of louvers therein, each louver forming an elongated slit through which a fluid to be heated or cooled by the medium may pass; and a corrugated edge formed upon one or more of the louvers for creating turbulence in the fluid, thereby disturbing laminar flow of the fluid across the louvers and promoting transfer of thermal energy between the medium in the tubes and the fluid;

wherein each louver includes a basal portion connected to the fin, and a fluid-directing plane extending between the basal portion and the corrugated edge.

6. A heat exchanger comprising:

at least one row of flattened tubes through which a heat exchange medium may pass;

a serpentine fin supported between adjacent tubes, the fin defining a plurality of louvers therein, each louver forming an elongated slit through which a fluid to be heated or cooled by the medium may pass;

a corrugated edge formed upon one or more of the louvers for creating turbulence in the fluid, thereby disturbing laminar flow of the fluid across the louvers and promoting transfer of thermal energy between the medium in the tubes and the fluid; and a plurality of connected undulating sections connected by a bridging section, wherein the louvers are formed in the undulating sections;

wherein each section includes two panels of louvers, the louvers in one of the panels being formed so as to direct the fluid away from fluid directed by the other of the two panels.

7. The heat exchanger of claim 6 wherein the louvers associated with a given panel disposed on an undulating section face away from the louvers formed upon a panel of an adjacent undulating section.

8. A automobile radiator comprising:

at least one row of flattened tubes through which a heat exchange medium may pass;

a serpentine fin supported between adjacent tubes, the fin defining a plurality of louvers therein, each louver forming an elongated slit through which air to be heated or cooled by the medium may pass; and a corrugated edge that extends from a generally flat basal portion formed upon one or more of the louvers for creating turbulence in the air, thereby disturbing laminar flow of the air across the louvers and promoting a transfer of thermal energy between the medium in the tubes and the air.

* * * * *